United States Patent [19]

Yokota et al.

[11] Patent Number: 5,013,168

[45] Date of Patent: May 7, 1991

[54] TANDEM STATION DOT MATRIX PRINTER

[75] Inventors: Katsuyoshi Yokota, Kamakura; Toshihiro Jingu, Hiratsuka; Kazunori Matsumoto, Fujisawa, all of Japan

[73] Assignee: NCR Corporation, Dayton, Ohio

[21] Appl. No.: 385,333

[22] Filed: Jul. 24, 1989

[30] Foreign Application Priority Data

Sep. 16, 1988 [JP] Japan ..... 63-230156

[51] Int. Cl.[5] ..... B41J 3/54

[52] U.S. Cl. ..... 400/82; 400/185; 400/323

[58] Field of Search ..... 400/82, 185, 187, 120, 400/323

[56] References Cited

U.S. PATENT DOCUMENTS

| | | | |
|---|---|---|---|
| 4,030,590 | 6/1977 | Wojdyla | 400/82 |
| 4,194,847 | 3/1980 | Grey | 400/320 |
| 4,204,779 | 5/1980 | Lee et al. | 400/82 |
| 4,576,490 | 3/1986 | Isobe | 400/82 |
| 4,692,041 | 9/1987 | Dyma et al. | 400/82 |

FOREIGN PATENT DOCUMENTS

| | | | |
|---|---|---|---|
| 2226394 | 5/1972 | Fed. Rep. of Germany . | |
| 5775 | 1/1981 | Japan | 400/82 |
| 58-89378 | 5/1983 | Japan . | |
| 123676 | 7/1984 | Japan | 400/82 |
| 32680 | 2/1985 | Japan | 400/82 |
| 61-230956 | 10/1986 | Japan . | |

*Primary Examiner*—Edgar S. Burr
*Assistant Examiner*—Joseph R. Keating
*Attorney, Agent, or Firm*—Wilbert Hawk, Jr.; Albert L. Sessler, Jr.; George J. Muckenthaler

[57] ABSTRACT

A dot matrix printer has two print head carriages, supported in parallel, and two print heads for printing a receipt and a journal in a tandem printing station arrangement. A drive cam with a rail on the periphery thereof is coupled to both carriages to drive the carriages in opposite directions upon rotation of the drive cam. The movement of one carriage acts as a balance to movement of the other carriage and thereby eliminates or substantially reduces vibration during printing operation.

18 Claims, 5 Drawing Sheets

TANDEM STATION DOT MATRIX PRINTER

BACKGROUND OF THE INVENTION

In the field of printing, the most common type printer has been the printer which impacts against record media that is caused to be moved past a printing line or line of printing. As is well-known, the impact printing operation depends upon the movement of impact members, such as print hammers or wires or the like, which are typically moved by means of an electromechanical drive system and which system enables precise control of the impact members.

In the field of dot matrix printers, it has been quite common to provide a print head which has included therein a plurality of print wire actuators or solenoids arranged or grouped in a manner to drive the respective print wires a very short, precise distance from a rest or non-printing position to an impact or printing position. The print wires are generally either secured to or engaged by the solenoid plunger or armature which is caused to be moved such precise distance when the solenoid coil is energized and wherein the plunger or armature normally operates against the action of a return spring.

It has also been quite common to provide an arrangement or grouping of such solenoids in a circular configuration to take advantage of reduced space available in the manner of locating the print wires in that specific area between the solenoids and the front tip of the print head adjacent the record media. In this respect, the actuating ends of the print wires are positioned in accordance with the circular arrangement and the operating or working ends of the print wires are closely spaced in vertically-aligned manner adjacent the record media. The availability of narrow or compact actuators permits a narrower or smaller print head to be used and thereby reduces the width of the printer because of the reduced clearance at the ends of the print line. The print head can also be made shorter because the narrow actuators can be placed in side-by-side manner closer to the record media for a given amount of wire curvature.

In the wire matrix printer which is utilized for receipt and for journal printing operations, the print head structure may be a multiple element type and may be horizontally disposed with the wire elements aligned in a vertical line and supported on a print head carriage which is caused to be moved or driven in a horizontal direction for printing in line manner across the receipt or journal paper and wherein the drive elements or transducers may be positioned in a circular configuration with the respective wires leading to the front tip of the print head. In the wire matrix printer which is utilized for business forms or like record media printing operation, the print head may be oriented in a manner wherein the nose is pointed downward for printing on the form, slip or like record media while the carriage and print head are moved above and across the form or like record media in the horizontal direction.

Further, in the wire matrix printer which is utilized for receipt, slip and journal printing operations, the individual print heads may be vertically oriented and printing performed by means of the print wires moving downwardly to impact on the record media. Alternatively, the individual print heads may be horizontally oriented and printing performed by means of the print wires moving horizontally to impact on the record media. A preferred number of four of such individual print heads is common in known arrangements.

In the dot matrix printer, there is a requirement for one or more small electric motors to drive certain parts of the printer. A small motor is used to drive the print head carriage in reciprocating manner in the printer that includes a stationary platen and a movable print head. The print head carriage and the associated print head are moved to appropriate and precise locations along the line of printing for dot matrix printing of alpha numeric characters or of graphics type characters. A second motor is used to drive the paper such as a receipt, a slip or a journal at the end of the printing operation and which paper drive is usually performed at the end of each line of printing. However, it is feasible to advance the paper at the end of the printing on a line without the necessity of moving the carriage and print head to the end of such line. This arrangement enables faster printing operation.

Along with the availability of narrow or compact actuators which permit a narrower or smaller print head and thereby reduce the width of the printer, it is also necessary to arrange other operating parts of the printer to reduce the overall size thereof.

A conventional printer includes two printing stations wherein a balancer moves in a direction opposite that of one or both carriages in order to avoid generation of vibrations between the moving carriages. Another arrangement in a conventional printer includes two carriages which are driven by means of a link and linkage bars in right and left or opposite directions to avoid the generation of vibrations due to the movement of the carriages.

Representative documentation in the field of dot matrix printers includes German No. 2226394 which discloses a fast printer having a first carriage for a first print head and a second carriage for a second print head. The carriages are secured to and carried by a cable trained around rollers and driven by a motor in transverse, opposing manner across the printer.

Japan No. 58-89378 discloses apparatus with side by side media and separate parallel print mechanisms.

Japan No. 61-230956 discloses a pair of parallel members, one supported on a cable, and a linkage between the members for moving the members in equal and opposite directions.

SUMMARY OF THE INVENTION

The present invention relates to dot matrix printers and is directed to a dot matrix printer of compact size for impact printing on record media and including a plurality of printing stations. The plurality of printing stations are used in an electronic cash register (ECR) or a point of sale (POS) terminal for printing on two or more record media. More particularly, the invention is directed to a two station printer, one station being positioned near the front of the printer and utilized for dot matrix printing on a receipt and a slip. The second station is positioned near the rear of the printer and is utilized for dot matrix printing on a journal. The two stations are disposed relative to each other in tandem manner and the print head carriages (front and rear) are driven by a drum type cam common to and positioned between the two carriages. The two carriages along with the associated print heads are driven by the drum type cam in equal and opposite directions during printing operations. The one station near the front of the printer is referred to as the receipt/slip station and the other station rearwardly of the one station is referred to as the journal station.

The receipt/slip station includes six, single wire solenoids, aligned across and supported by the front carriage. The solenoids are vertically oriented for printing downwardly on receipt paper or on a slip disposed on a fixed platen.

The journal station also includes six, single wire solenoids, aligned across and supported by the rear carriage. The solenoids are horizontally oriented for printing in the rearward direction against journal paper driven past a fixed platen.

The single drum type cam drive is positioned between the receipt/slip station and the journal station. The drum cam includes a rail on the periphery thereof which engages with a pair of rollers on each print head carriage. Rotation of the drum cam in a predetermined direction causes the receipt/slip print head carriage to move in one direction across the printer and causes the journal print head carriage to move in an equal and opposite direction.

A receipt paper roll is disposed rearwardly and downwardly of the receipt/slip station and receipt paper is driven across the platen for printing on the paper. A knife mechanism is provided at the front of the printer for cutting the receipt paper after printing thereon. The printer also includes a slip table positioned for receiving a slip for printing thereof at the receipt/slip station.

A journal supply roll is disposed rearwardly and downwardly of the journal station and the journal paper is driven past the journal station for printing on the paper. A journal takeup roller is disposed rearwardly and upwardly of the journal station.

In accordance with the present invention, there is provided a dot matrix printer comprising tandem printing stations, one station having first print head means and a carriage carrying said first print head means, a first platen positioned in opposed manner and operably associated with said first print head means for enabling printing on first record media movable past said first platen, another station having second print head means and a carriage carrying said second print head means, a second platen positioned in opposed manner and operably associated with said second print head means for enabling printing on second record media movable past said second platen, and drive means positioned between said first carriage and said second carriage and operably engageable with said first carriage and with said second carriage for driving said carriages in equal and opposite directions across said printer for printing on said first and said second record media.

In view of the above discussion, a principal object of the present invention is to provide a two station, compact printer.

Another object of the present invention is to provide a compact printer wherein two printing stations are arranged in tandem manner and one drive member is positioned between and is operably associated with the two printing stations.

An additional object of the present invention is to provide a compact printer wherein two printing stations are arranged one rearward of the other and one drive member is provided to enable simultaneous printing on two record media.

A further object of the present invention is to provide a compact printer having tandem printing stations including print heads carried on carriages at the printing stations for printing on two record media upon travel of the carriages in equal and opposite directions across the printer in order to substantially reduce or eliminate vibration in printer operation.

Additional advantages and features of the present invention will become apparent and fully understood from a reading of the following description taken together with the annexed drawing.

DESCRIPTION OF THE PREFERRED EMBODIMENT

Figure 1:
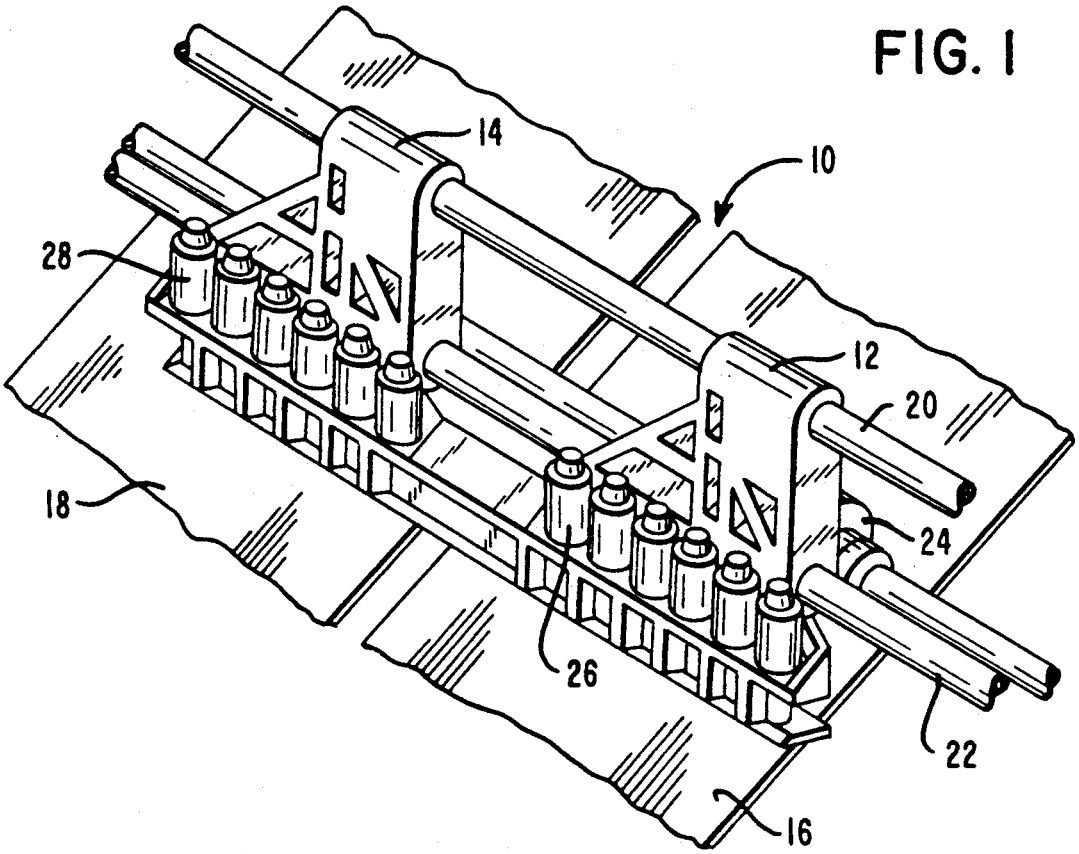
PRIOR ART FIG. 1
FIG. 1 is a perspective view of a portion of a dot matrix printer of a conventional type.

Prior to describing the structure of the present invention, it is convenient to disclose the arrangement of the carriage section of a conventional printer 10, as shown in FIG. 1. The printer 10 is a two station printer having carriages 12 and 14 connected to each other and disposed in side-by-side relationship for printing on separate record media, such as a journal 16 and a receipt 18. The carriages 12 and 14 are slidably supported by guide shafts 20 and 22 and a rail cam 24 drives the carriages in right and left directions across the printer. Each of the carriages 12 and 14 carry a plurality of dot matrix print heads, as print head 26 on carriage 12 and print head 28 on carriage 14. The carriages 12 and 14 are simultaneously driven in the lateral direction by the rail cam 24 for printing operations.

The conventional printer 10 has a disadvantage in that the printer itself needs to be sufficiently larger to provide for disposition of the two carriages 12 and 14. Additionally, it is possible that one carriage and its associated mechanism may be heavier than the other and thereby cause generation of vibration at relatively high printing speeds. One remedy for such vibration is to provide a balancer or equalizer which moves in the direction opposite that of the carriage. This may result in a balancer for each carriage dependent upon the difference in weight between the carriages and the direction of travel of the carriages.

Figure 2:
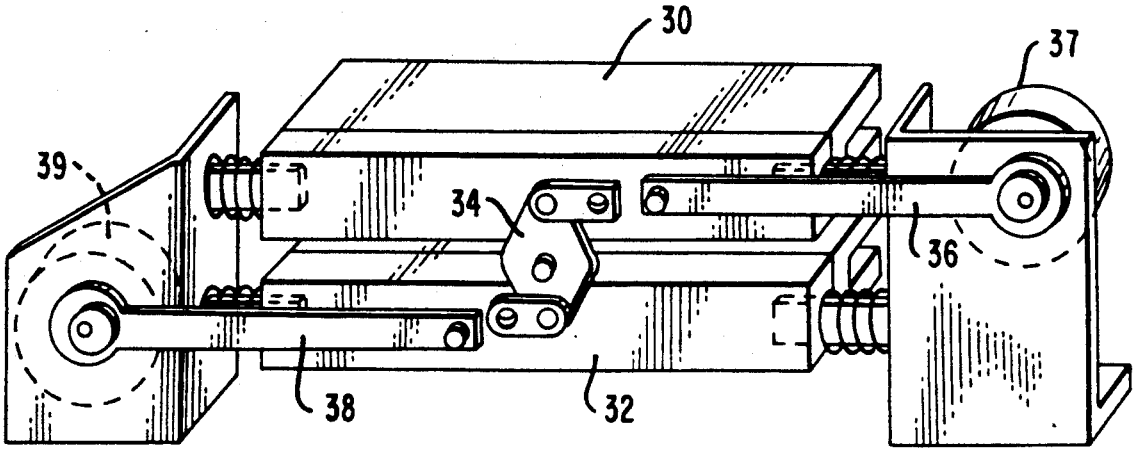
FIG. 2 PRIOR ART
FIG. 2 is a perspective view of a portion of a conventional type printer having linkage coupling two carriages.

One arrangement of the prior art which discloses means to avoid the generation of vibrations is shown in FIG. 2. The arrangement includes two carriages 30 and 32 which are constructed to be driven by means of a link 34 and link bars 36 and 38 in right and left directions. The movements of the two carriages 30 and 32 are in opposite directions to avoid the generation of vibrations due to driving of the carriages. This arrangement is adapted to print on one record medium at a high speed rather than on two separate record mediums. Additionally, this arrangement has a disadvantage in that the distance of movement or travel of the carriages 30 and 32 is limited due to use of the link 34. Further, it is to be noted that two motors 37 and 39 are required to drive the two carriages 30 and 32 in the operation of the printer.

Figure 3:
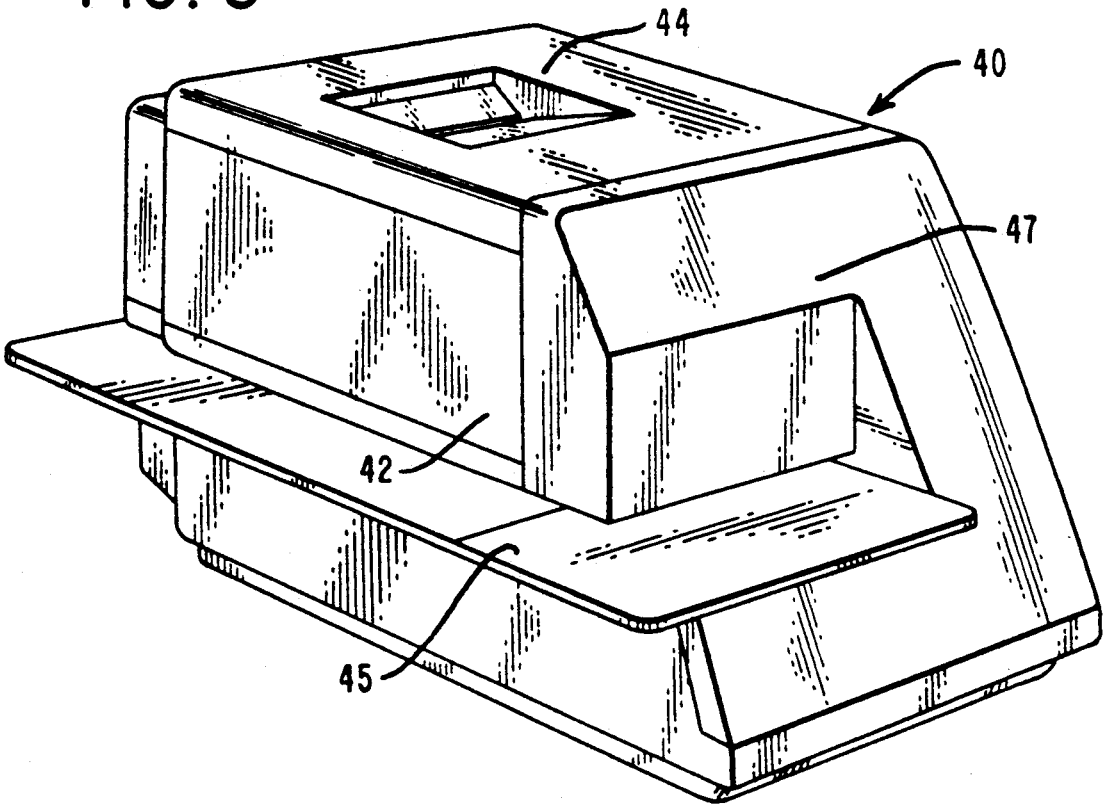
FIG. 3 is a perspective view of a dot matrix printer incorporating the subject matter of the present invention.

Referring now to FIG. 3, a printer 40 is designed as a two station, receipt/slip and journal printer. The receipt/slip printing station occupies a front portion 42 and the journal printing station occupies a rearward portion 44 of the printer. A slip table 45 is provided along the left hand side of the printer 40. A front cover 47 swings toward the right to expose certain operating parts of the printer 44.

Figure 4:
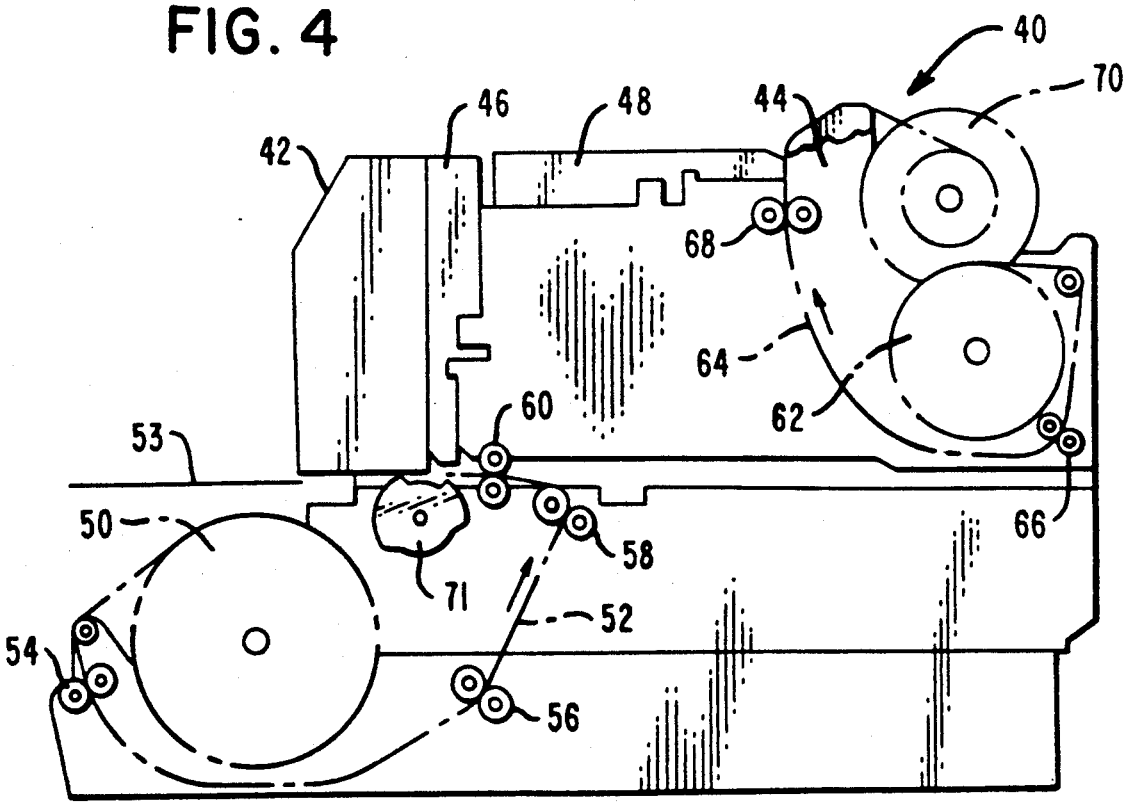
FIG. 4 is a right side elevational view in diagrammatic form showing the arrangement of certain elements of the printer.
Figure 5:
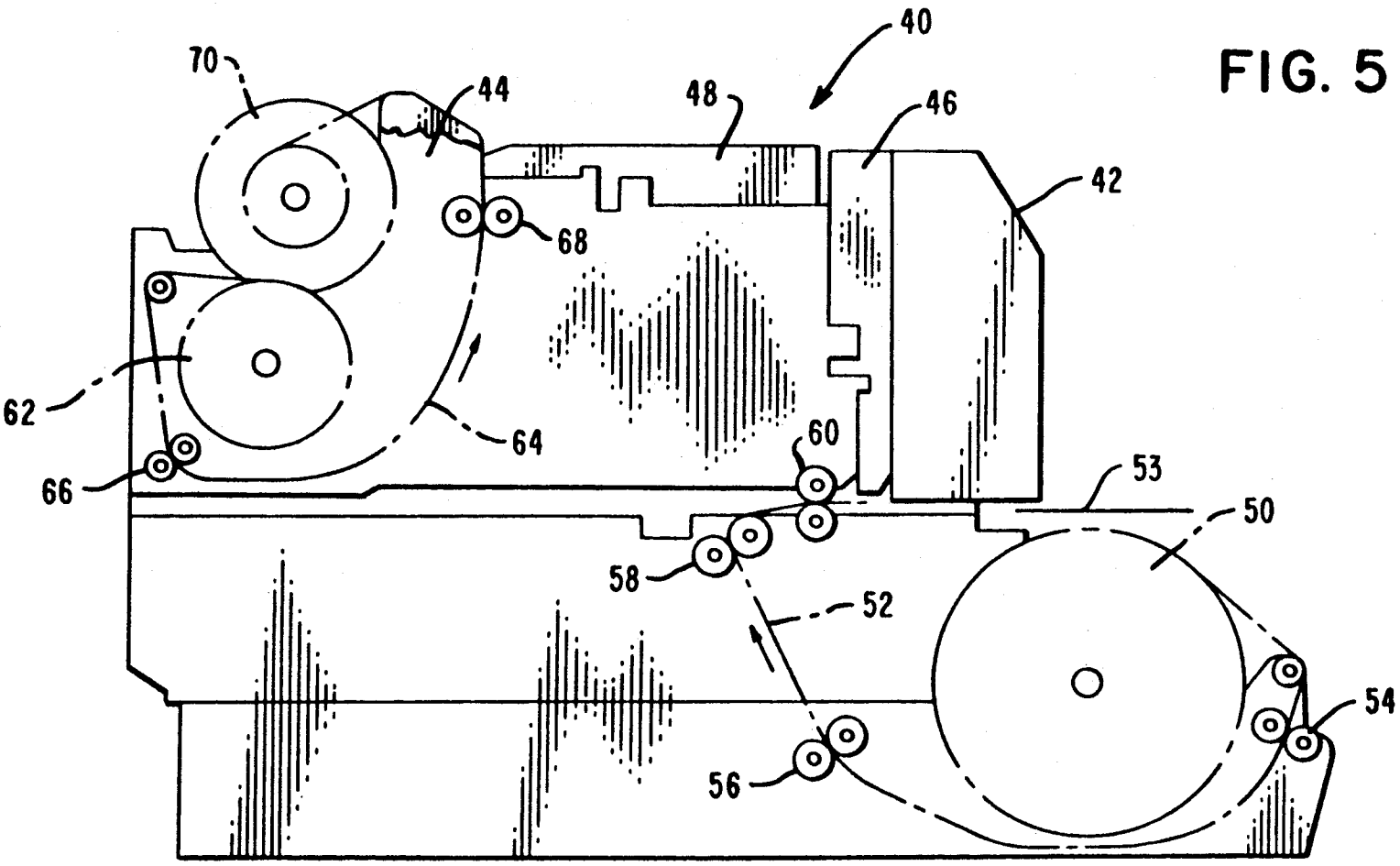
FIG. 5 is a left side elevational view in diagrammatic form showing the arrangement of such certain elements of the printer.

FIGS. 4 and 5 are right and left side elevational views and show certain elements of the printer 40 in diagrammatic form. The receipt/slip portion 42 and the journal portion 44 include individual print wire solenoids (not shown) along with a ribbon cassette 46 for the receipt/slip printing station operation and a ribbon cassette 48 for the journal station printing operation. A roll 50 of receipt paper is journaled at the front of the printer and the receipt paper 52 is driven and guided by appropriate pairs of rollers, as 54, 56, 58 and 60 in a path past the receipt/slip printing station for printing operation and issuance of a receipt 53 after cutting thereof from the receipt paper 52. A supply roll 62 of journal paper is positioned in a cradle at the rear of the printer 40 and the journal paper 64 is driven and guided by appropriate pairs of rollers, as 66 and 68 in a path from the supply roll 62, past the journal printing station, and onto a take-up roll 70. A timing plate 71 (FIG. 4) is provided at the receipt/slip printing station.

Figure 6:
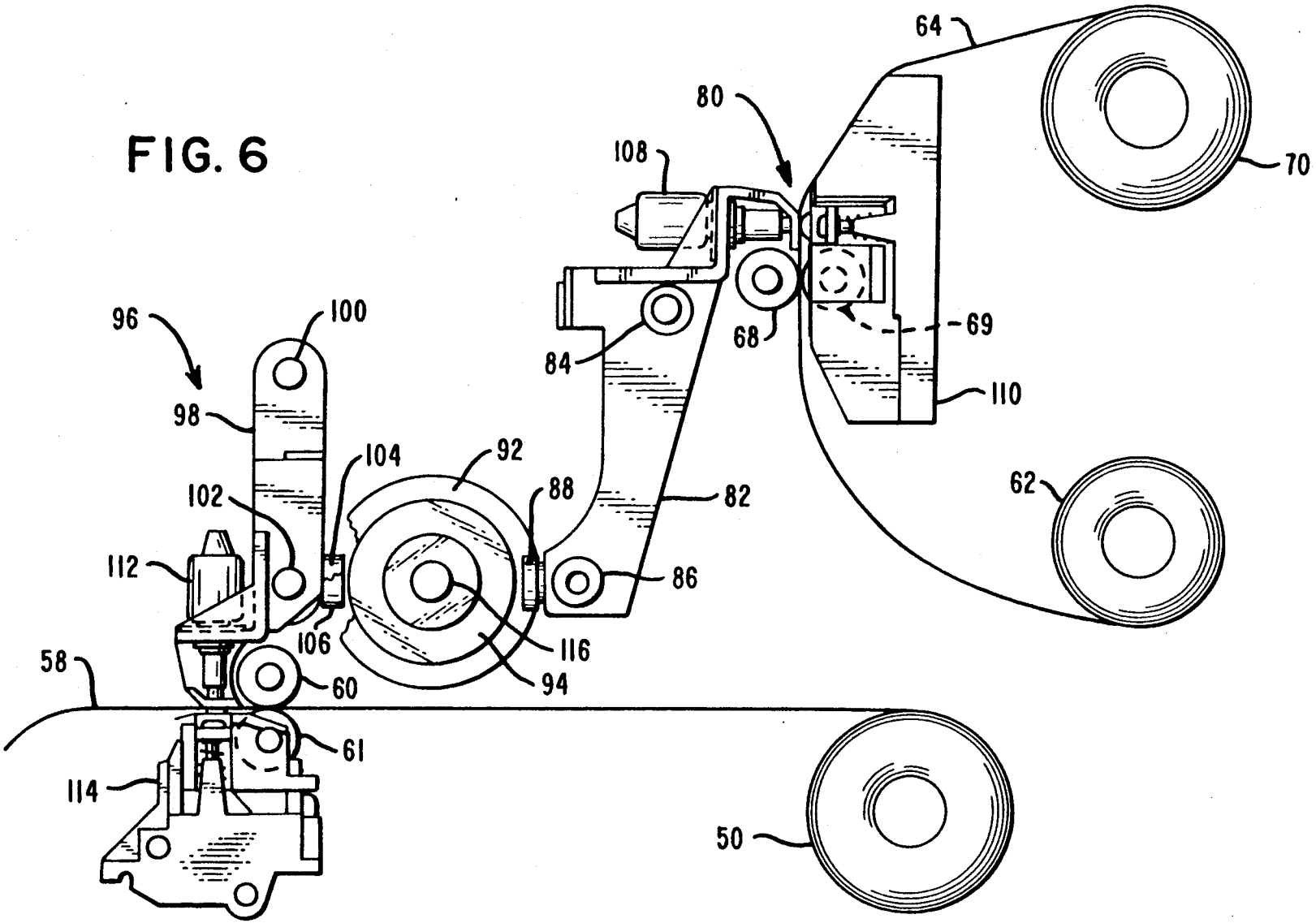
FIG. 6 is a right side elevational view showing the arrangement of the two printing stations of the printer.
Figure 7:
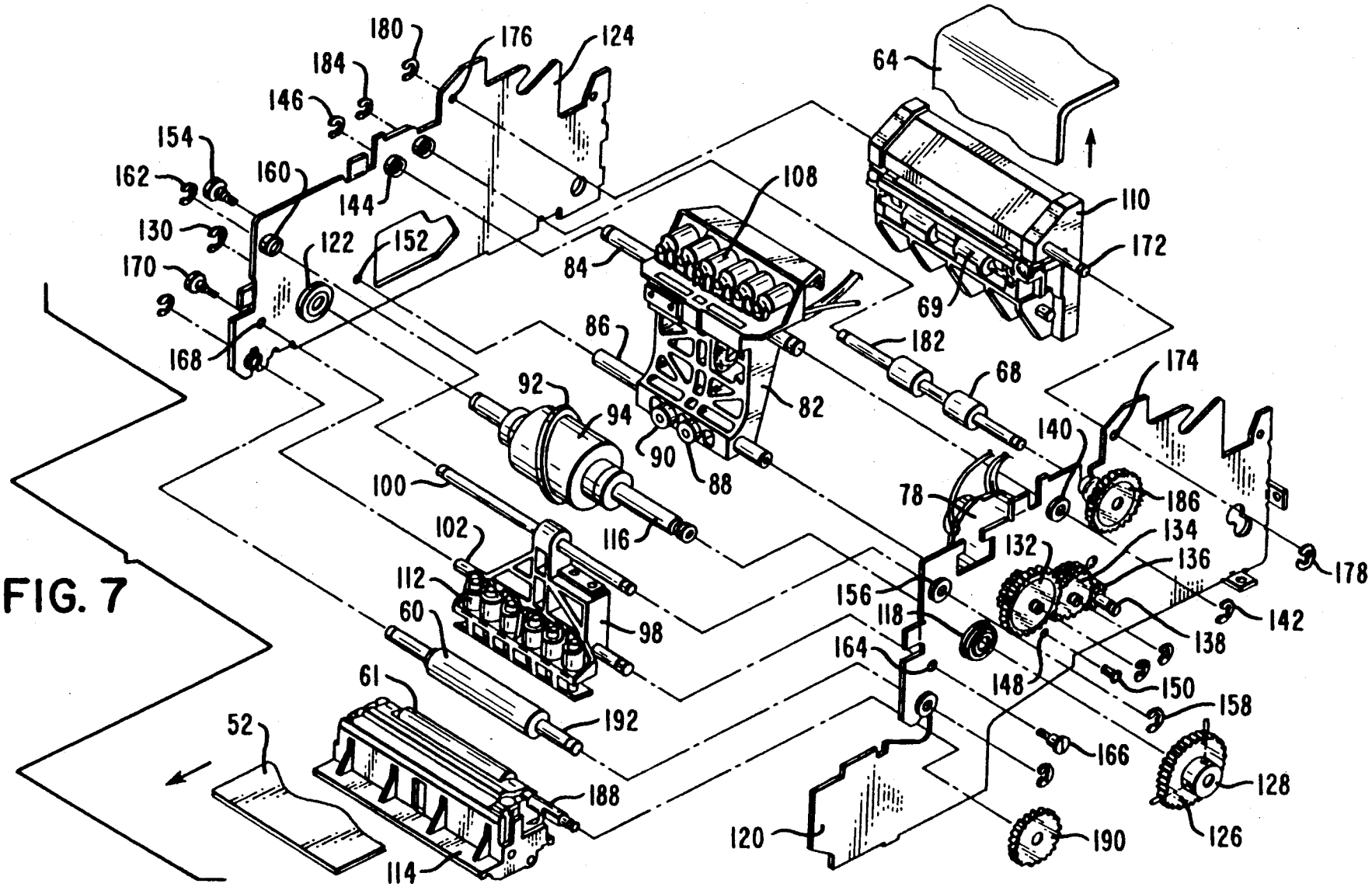
FIG. 7 is an exploded perspective view of a preferred embodiment of the structure of the present invention.

Referring now to FIGS. 6 and 7, the journal supply roll 62 is suitably supported rearwardly and downwardly from the journal printing station 80 and the journal takeup roll 70 is suitably supported rearwardly and upwardly from the station 80. A print head carriage 82 for the journal printing station 80 (FIG. 6) is slidably supported on guide shafts 84 and 86. The carriage 82 has a pair of spaced rollers 88 and 90 (FIG. 7) journaled at the lower front thereof just in front of the guide shaft 86. The rollers 88 and 90 are positioned and formed to operate with a rail 92 of a drum cam 94. The drum cam 94 is driven in well-known manner by suitable drive means, such as the motor 78 (FIG. 7).

The receipt supply roll 50 is suitably supported rearwardly and downwardly from the receipt/slip printing station 96. A print head carriage 98 for the receipt/slip printing station 96 is slidably supported on guide shafts 100 and 102. The carriage 98 has a pair of spaced rollers 104 and 106 (FIG. 6) journaled at the lower rear thereof just to the rear of the guide shaft 102. The pair of rollers 88 and 90 and the pair of rollers 104 and 106 are disposed in opposed manner on the respective carriages 82 and 98 and are connected to engage and operate with the rail 92 on the circumference of the drum cam 94.

The journal carriage 82 carries six single wire print heads or solenoids, as 108, for dot matrix printing on the journal paper 64 which is driven in a path past a journal station platen 110. The receipt carriage 98 carries six single wire print heads or solenoids, as 112, for dot matrix printing on the receipt paper 52 which is driven in a path by the pair of rollers, as 60 and 61, past a receipt station platen 114.

FIG. 7 shows details of the important parts of the printer 40 in exploded manner and clarifies the showing of certain parts in FIG. 6, which is somewhat diagrammatic in the illustration of such important and certain parts. The drum cam 94 is driven in a predetermined direction by the motor 78 (FIG. 7) and the rail 92 is positioned between and engaged with rollers 88 and 90 of the journal carriage 82 and is positioned between and engaged with rollers 104 and 106 of the receipt carriage 98. The drum cam 94 includes a shaft 116 which is rotatably supported at one end thereof in a bearing 118 on a side plate 120. The other end of the shaft 116 is likewise rotatably supported in a bearing 122 on a side plate 124. The one end of the shaft 116 which is journaled in the bearing 118 extends through the side plate 120 and also extends through the bearing 118. A gear 126 is secured to the one end of the shaft 116 by means of a hub 128 and suitable fasteners. The other end of the shaft 116 extends through the bearing 122 and a clip 130 is provided to secure the shaft to the side plate 124. The gear 126 is positioned to mesh with a gear 132 which is positioned to mesh with a gear 134. The gear 134 is positioned to mesh with a gear 136 which is secured to a shaft 138 of the motor 78. The motor 78 is mounted on the inside of the side plate 120. Rotation of the motor shaft 138 rotates the gears 136, 134, 132 and 126 in their respective directions so as to rotate the drum cam 94 in the required predetermined direction for driving the print head carriages 82 and 98 for printing operations.

The journal carriage 82 is slidably supported on the guide shafts 84 and 86. One end of the shaft 84 extends through a hub 140 (FIG. 7) and is fastened to the side plate 120 by a clip 142. The other end of the shaft 84 extends through a hub 144 and is fastened to the side plate 124 by a clip 146. One end of the guide shaft 86 extends through a hole 148 and is fastened to the side plate 120 by a screw 150. The other end of the shaft 86 extends through a hole 152 and is fastened to the side plate 124 by a screw 154.

In similar manner, the receipt carriage 98 is slidably supported on the guide shafts 100 and 102. One end of the shaft 100 extends through a hub 156 (FIG. 7) and is fastened to the side plate 120 by a clip 158. The other end of the shaft 100 extends through a hub 160 and is fastened to the side plate 124 by a clip 162. One end of the guide shaft 102 extends through a hole 164 and is fastened to the side plate 120 by a screw 166. The other end of the shaft 102 extends through a hole 168 and is fastened to the side plate 124 by a screw 170.

The journal platen 110 is supported on a shaft 172 which extends through holes 174 and 176 (FIG. 7) and is secured to the side plates 120 and 124 by clips 178 and 180. The platen 110 is secured and fixed in position so as to be in face-to-face relationship with the solenoids 108 (FIG. 6) for the journal printing operations. The journal platen 110 includes the roller 69 which is supported by suitable bearings and which roller acts as an idler or driven roller in the journal drive mechanism. The roller 68 includes a shaft 182 which extends through appropriate hubs in the side plates 120 and 124. One end of the shaft 182 is fastened to the side plate 124 by a clip 184. The other end of the shaft 182 is secured to a gear 186 which is driven by a motor or other suitable drive means (not shown). Therefore, the roller 68 operates as the drive roller and the roller 69 operates as the idler roller for advancing the journal paper 64 from the supply roll 62, past the journal printing station 80 and onto the takeup roll 70.

In similar manner, the receipt platen 114 includes the drive roller 61 and the platen and the roller 61 are disposed in a position generally under the receipt print station 96. The drive roller 61 is on a shaft 188, one end of which extends through an opening in the side plate 120 and is secured to a gear 190 (FIG. 7), which is driven by suitable drive means (not shown). The roller 60 includes a shaft 192, the ends of which extend through suitable openings or hubs in the side plates 120 and 124 and the shaft 192 is fastened by suitable clips. The roller 61 operates as the drive roller and the roller 60 operates as the idler roller for advancing the receipt paper from the supply roll 50 and across the platen 114. The platen 114 is secured and fixed in position so as to be in face-to-face relationship with the solenoids 112 (FIG. 6) for the receipt printing operations.

The rail 92 is formed on the periphery of the drum cam 94 in an oblique manner and follows a continuous path from one end of the drum cam to the other end and return to the one end. The rollers 88 and 90 (FIG. 7) on the journal carriage 82 and the rollers 104 and 106 (FIG. 6) on the receipt carriage engage the rail 92 in nip manner wherein rotation of the drum cam 94 drives the two carriages in reciprocal movement across the printer 40. In this regard, the two carriages are driven in equal and opposite directions by reason that the ends of the rail 92 are 180° out of phase with each other to derive the desired printing operation.

In the operation of the structure of the present invention, the journal carriage 82 and the receipt carriage 98 are slidably supported on guide shafts 84 and 86 and on guide shafts 100 and 102, respectively. The rail 92 of the drum cam 94 is engaged with the rollers 88 and 90 of the journal carriage 82 and with the rollers 104 and 106 of the receipt carriage 98. Rotation of the drum cam 94 causes transverse movement of the journal carriage 82 and of the receipt carriage 98 in equal distance and opposite directions. When the journal carriage 82 is at the left side of the printer 40 and the receipt carriage 98 is at the right side of the printer, rotation of the drum cam 94 will simultaneously drive the journal carriage 82 toward the right and drive the receipt carriage 98 toward the left in printing operations. The two carriages 82 and 98 are equal in weight so that even balance is obtained during the reciprocal movement and vibration is substantially reduced or eliminated during the printing operations. The two carriages 82 and 98 are disposed in tandem manner and displaced from each other in parallel relationship and driven along a limited path for a distance to enable operation of the compact printer 40. In this regard, the two print head carriages 82 and 98 for journal and receipt printing operations occupy the space normally used by one carriage, thus enabling miniaturization of the printer 40.

The structure of the present invention provides that one drum cam 94 having an annular rail 92, which is 180° different in phase at the ends thereof, is utilized for driving the two carriages 82 and 98 in reciprocating manner in opposite directions in printing operations and in an environment which avoids the generation of vibration caused by movement of the carriages 82 and 98. The printer 40 is constructed so that the two carriages 82 and 98 are disposed in parallel with each other and in tandem position so as to be moved the same distance and along separate paths. The arrangement enables transporting of and printing on separate record media in a compact printer.

It is thus seen that herein shown and described is a compact dot matrix printer that includes two carriages and drive apparatus for the two carriages for driving thereof an equal distance and in opposite directions in a manner wherein one carriage acts as a balancing member for the other carriage. The arrangement substantially reduces or eliminates generation of vibration which may occur during the printing operation. The two carriages in parallel position and in tandem relationship provide a narrow width printer for printing on at least two record media at the same time. The apparatus and arrangement enable the accomplishment of the objects and advantages mentioned above, and while the preferred embodiment of the invention has been disclosed herein, variations thereof may occur to those skilled in the art. It is contemplated that all such variations not departing from the spirit and scope of the invention hereof are to be construed in accordance with the following claims.

What is claimed is:

1. A printer comprising a frame including spaced side plates, a first printing station positioned between and supported by said side plates and including a first guide shaft means a first carriage carried by said first guide shaft means and a print head carried on said first carriage for printing on a first record medium, a second printing station positioned in tandem relationship with respect to said first printing station and positioned between and supported by said side plates and including a second guide shaft means parallel to said first guide shaft means a second carriage carried by said second guide shaft means and a print head carried on said second carriage for printing on a second record medium, and a single driving means common to and positioned between said first guide shaft means and said second guide shaft means and coupled to said first printing station carriage and to said second printing station carriage for driving each of said carriages an equal distance and in opposite directions in printing operations.

2. The printer of claim 1 wherein the first printing station is a station for printing on receipt and form paper and the second printing station is a station for printing on journal paper and is positioned rearwardly of said first printing station.

3. The printer of claim 1 wherein said driving means is a cam member coupled to said carriages.

4. The printer of claim 1 wherein each of said carriages includes roller means coupled to said driving means.

5. The printer of claim 1 wherein the first record medium comprises receipt paper and said printer includes a supply roll of said receipt paper at the front of said printer and also includes means for advancing said receipt paper from said supply roll and past said first printing station.

6. The printer of claim 1 wherein the second record medium comprises journal paper and said printer includes a supply roll of said journal paper at the rear of said printer and also includes means for advancing said journal paper from said supply roll and past said second printing station.

7. The printer of claim 3 wherein said cam member includes a rail on the periphery thereof and coupled to said carriages.

8. The printer of claim 4 wherein said roller means comprises a pair of spaced rollers, one pair being journaled on said first carriage forward of said driving means and another pair being journaled on said second carriage rearward of said driving means.

9. The printer of claim 4 wherein said roller means comprise a pair of spaced rollers journaled on each carriage and said driving means comprises a cam member having a rail on the periphery thereof and running in a path between and engageable with each of said pair of spaced rollers.

10. A dot matrix printer comprising a frame including spaced side plates, a first printing station positioned between and supported by said side plates and having a first guide shaft means a first carriage carried by said first guide shaft means and a print head carried on said first carriage for printing dot matrix characters on a first record medium, a second printing station positioned in tandem relationship with respect to said first printing station and positioned between and supported by said side plates and having a second guide shaft means parallel to said first guide shaft means a second carriage carried by said second guide shaft means and a print head carried on said second carriage for printing dot matrix characters on a second record medium, and a single drive means common to and positioned between said first guide shaft means and said second guide shaft means and coupled to said first printing station carriage and to said second printing station carriage for driving each of said carriages an equal distance and in opposite directions in printing operations.

11. The dot matrix printer of claim 10 wherein the first printing station is used for printing on receipt paper and the second printing station is used for printing on journal paper and is positioned rearwardly of said first printing station.

12. The dot matrix printer of claim 10 wherein said drive means is a drum cam member coupled to said first carriage and to said second carriage.

13. The dot matrix printer of claim 10 wherein each of said print heads comprise a plurality of single wire actuators.

14. The dot matrix printer of claim 10 wherein each of said carriages includes roller means coupled to said drive means.

15. The dot matrix printer of claim 12 wherein said drum cam member includes a rail on the periphery thereof and coupled to said first carriage and to said second carriage.

16. The dot matrix printer of claim 14 wherein said roller means comprises a pair of spaced rollers, one pair being journaled on said first carriage forward of said drive means and the other pair being journaled on said second carriage rearward of said drive means.

17. The dot matrix printer of claim 14 wherein said roller means comprise a pair of spaced rollers journaled on each of said first and said second carriage and said drive means comprises a drum cam member having a rail on the periphery thereof and running in a path between and engageable with each of said rollers of said pair thereof.

18. The dot matrix printer of claim 10 wherein said first record medium comprises receipt paper printed at said first printing station and said second record medium comprises journal paper printed at said second printing station rearward of said first printing station.

* * * * *